US009343806B2

(12) United States Patent
Desclos et al.

(10) Patent No.: US 9,343,806 B2
(45) Date of Patent: May 17, 2016

(54) ANTENNAS INTEGRATED IN SHIELD CAN ASSEMBLY

(75) Inventors: Laurent Desclos, San Diego, CA (US); Jeffrey Shamblin, San Marcos, CA (US)

(73) Assignee: ETHERTRONICS, INC., San Diego, CA (US)

( * ) Notice: Subject to any disclaimer, the term of this patent is extended or adjusted under 35 U.S.C. 154(b) by 601 days.

(21) Appl. No.: 13/555,080

(22) Filed: Jul. 20, 2012

(65) Prior Publication Data

US 2013/0187818 A1 Jul. 25, 2013

Related U.S. Application Data

(60) Provisional application No. 61/510,010, filed on Jul. 20, 2011.

(51) Int. Cl.
*H01Q 13/10* (2006.01)
*H01Q 1/52* (2006.01)

(52) U.S. Cl.
CPC ..... *H01Q 1/526* (2013.01); *H01Q 13/10* (2013.01)

(58) Field of Classification Search
CPC ..... H01Q 1/42; H01Q 1/38; H01Q 1/273; H01Q 21/08; H01Q 13/10
See application file for complete search history.

(56) References Cited

U.S. PATENT DOCUMENTS

| | | | | |
|---|---|---|---|---|
| 8,738,103 | B2 * | 5/2014 | Puente Baliarda et al. | 455/575.7 |
| 2004/0137971 | A1 * | 7/2004 | Shoji | 455/575.5 |
| 2006/0077113 | A1 * | 4/2006 | Yuanzhu | 343/770 |
| 2010/0283691 | A1 * | 11/2010 | Su et al. | 343/702 |
| 2012/0280876 | A1 * | 11/2012 | Qu | 343/767 |

* cited by examiner

*Primary Examiner* — Trinh Dinh
(74) *Attorney, Agent, or Firm* — Coastal Patent Law Group, P.C.

(57) ABSTRACT

Antennas are integrated into shield cans by etching one or more slots from a body portion thereof. Multiple antennas can be grouped onto a single shield can to provide both cost and space saving features. Antenna feed and ground connections are positioned on the circuit board and connections to the antenna are made when the shield can connects to the circuit board assembly.

13 Claims, 10 Drawing Sheets

Figure 1A:
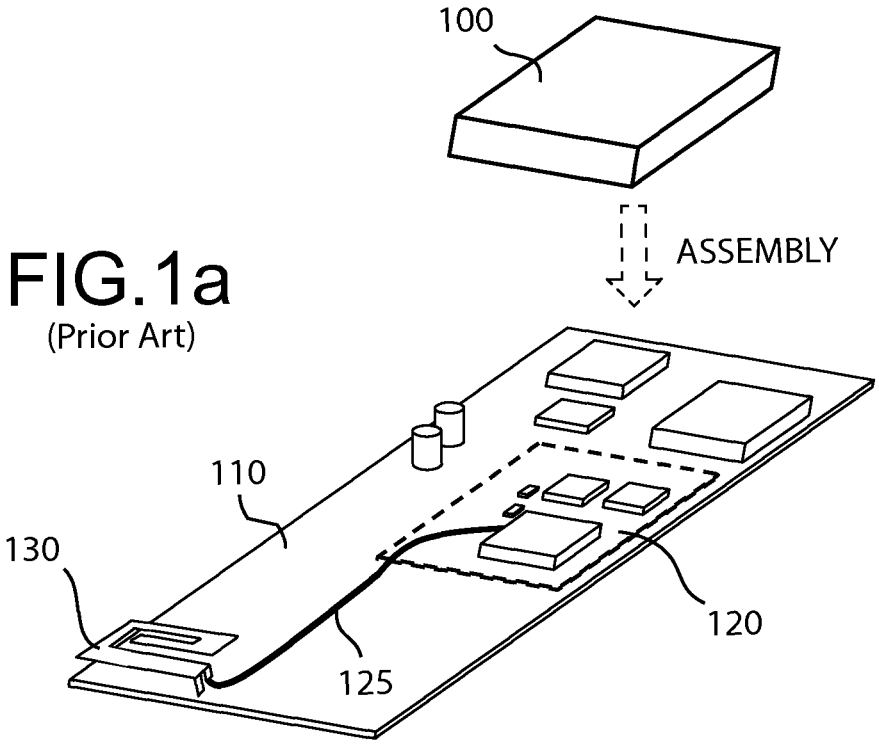
FIG.1a (Prior Art)

FIG.3a
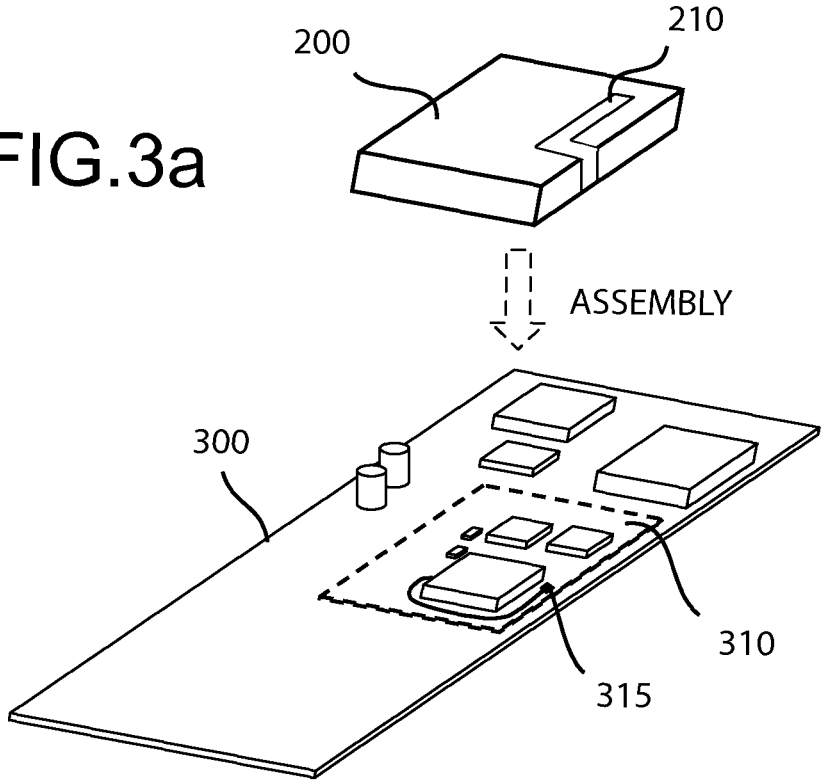
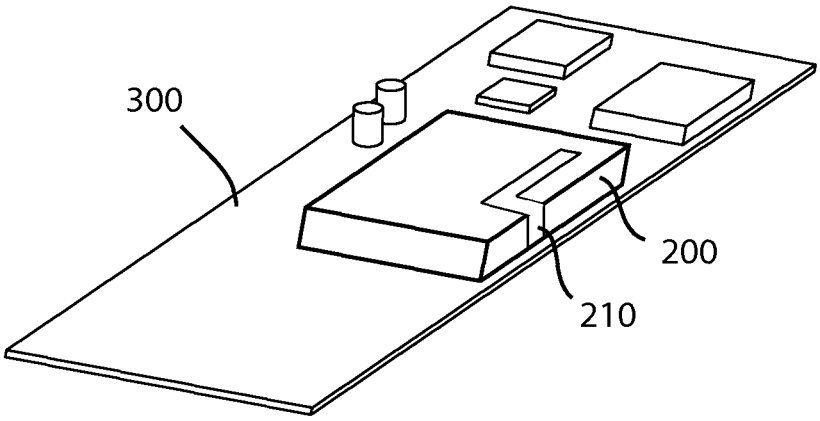
FIG.3b

ANTENNAS INTEGRATED IN SHIELD CAN ASSEMBLY

CROSS-REFERENCE TO RELATED APPLICATIONS

This application claims benefit of priority to U.S. Provisional Ser. No. 61/510,010, filed Jul. 20, 2011, and titled "ANTENNAS INTEGRATED IN SHIELD CAN ASSEMBLY"; the contents of which are hereby incorporated by reference.

BACKGROUND OF THE INVENTION

1. Field of the Invention

This invention relates generally to the field of wireless communications; and more particularly, to antennas for such wireless communications being integrated into shield can assemblies, and related methods.

2. Description of the Related Art

Electromagnetic shielding in the form of shield cans is used extensively in communication circuits to isolate RF and digital circuits. Electromagnetic shielding, in effect, is used to keep intended signals internal to a region, or used to keep external signals from entering a region. Electromagnetic shielding that blocks radio frequency electromagnetic radiation is also known as RF shielding. The shielding can reduce the coupling of RF currents, radio waves, electromagnetic fields, and electrostatic fields between circuits in a communication system, with these circuits often located in close proximity to each other or on a shared circuit board.

Because portability is an ongoing necessity in the portable electronics market, size constraints must remain a primary focus of component manufactures. Cell phones, for example, are becoming smaller in size and lighter in weight while providing an increased number of useable features, such as internet, radio, television (DVB-H), communications, and others. To meet the demand for multi-application cell phones, additional and/or larger antennas and other components have been required. Cell phone and other portable electronic device manufacturers are moving towards reducing size of components and eliminating unnecessary bulk space or reusing space.

Antennas in wireless mobile devices are typically placed internal to the mobile device for aesthetics, cost, and other reasons. The antenna will require a certain volume to operate efficiently at a set frequency. With more features being designed into mobile devices such as FM radios, digital TV receivers, and GPS receivers, volume and circuit board area are becoming constrained.

SUMMARY OF THE INVENTION

In a general embodiment of the invention, a shield can assembly comprises one or more antennas built into a volume thereof. The one or more antennas can be connected to a feed contact pad on a circuit board at a position adjacent to an edge of the shield can.

In accordance with certain embodiments, a shield can is provided having one or more slots etched into a body thereof. At least one of the slots is adapted to radiate when excited, such as by electrical feed, or electromagnetic coupling of a nearby driven element, such that the shield can having an integrated antenna is adapted for at least one of transmission (Tx), or reception (Rx), of an electromagnetic signal.

The shield can generally comprises a conductive body having one or more slots etched into at least a portion thereof.

The slots can be disposed on one or more surfaces of the body including the top, bottom, or one of the side surfaces.

In certain embodiments, a shield can having multiple embedded antennas comprises a first antenna defined by a first slot portion and a second antenna defined by a second slot portion. Each of the first and second slot portions can be disposed about one or more surfaces of the body portion of the shield can. The first antenna can be electrically driven via contact pads, or a transmission line. The second antenna can be electrically driven independent of the first antenna, or electromagnetically coupled to the first antenna. In this regard, multiple antennas can be provided within a single shield can body.

In certain other embodiments, an antenna is provided comprising a shield can body having one or more slots embedded therein, a conductive enclosure adapted to substantially surround the shield can body having one or more slots embedded therein, and a transmission line connected to the shield can. The shield can is adapted to receive radiofrequency (RF) signals from the transmission line. In this regard, one or more slots of the conductive enclosure are excited by the shield can, and the shield can operates as a "feed source" or RF feed for one or more slots of the conductive enclosure.

In other embodiments, a shield can body comprises two or more slots etched therein. One or more of the slots are electrically connected to a transmission line to form one or more electrically driven slots, and other slots therein are configured to electromagnetically couple with the one or more electrically driven slots. In this regard a first slot is electrically driven via a transmission line and a second of the slots is electromagnetically coupled to the first slot.

BRIEF DESCRIPTION OF THE INVENTION

FIG. 1*a* illustrates a communications circuit for use with a wireless device in accordance with a prior art embodiment, wherein a shield can is used to isolate RF signals between an antenna radiator and an electric circuit.

Figure 1B:
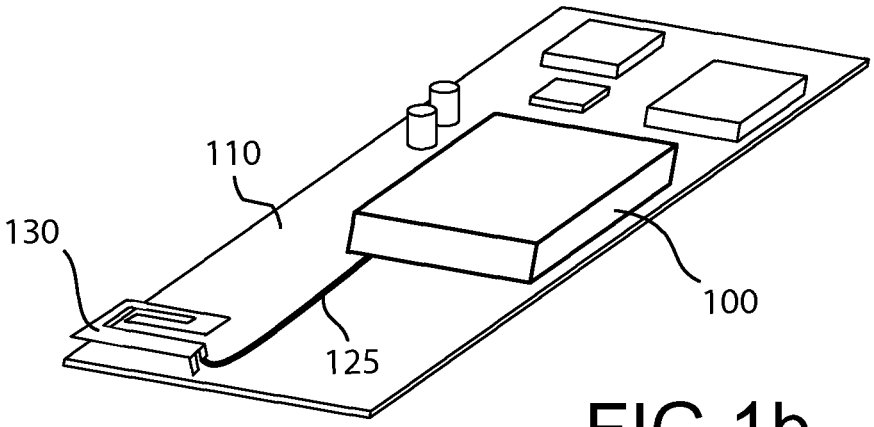
FIG.1b (Prior Art)

FIG. 1*b* illustrates the assembled circuit of FIG. 1*a*.

Figure 2A:
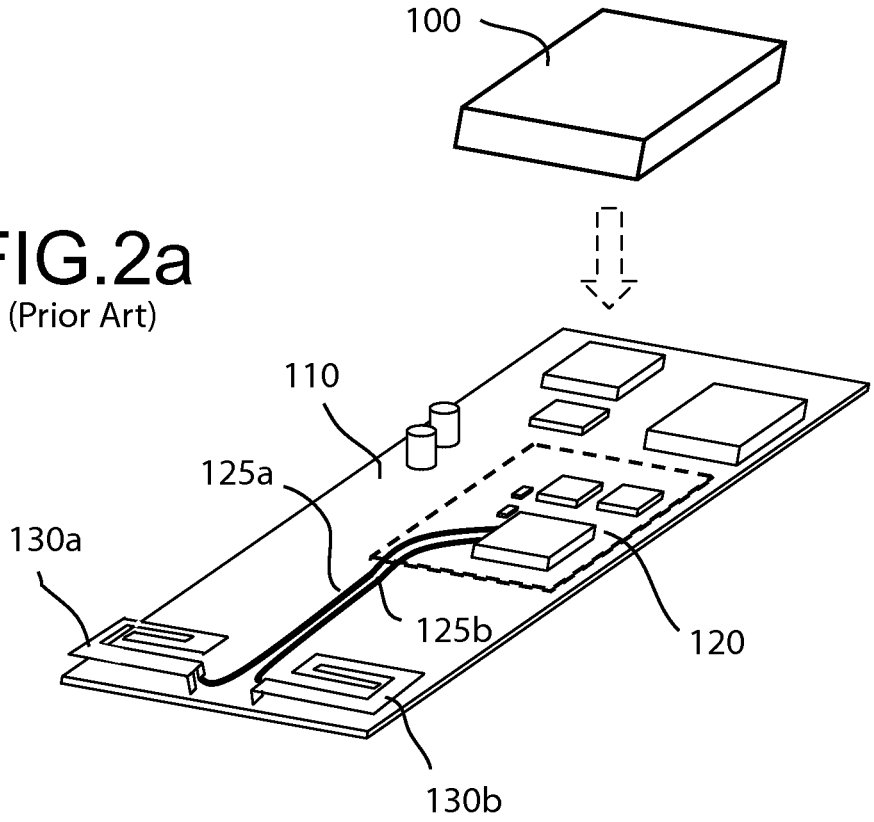
FIG.2a (Prior Art)

FIG. 2*a* illustrates a communications circuit for use with a wireless device in accordance with a prior art embodiment, wherein a shield can is used to isolate RF signals between two antenna radiators and an electric circuit.

Figure 2B:
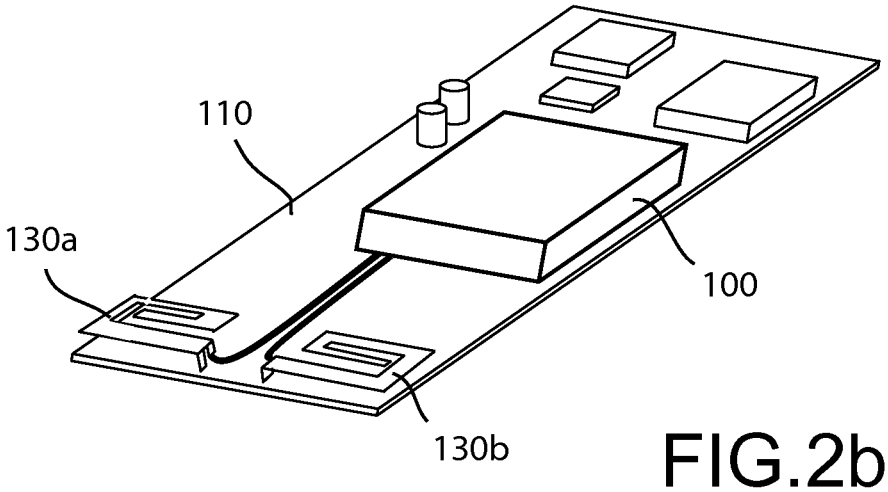
FIG.2b (Prior Art)

FIG. 2*b* illustrates the assembled circuit of FIG. 2*a*.

FIG. 3*a* illustrates a shield can comprising an antenna disposed on a surface thereof; the antenna being placed on the shield can provides reduced volume when compared to prior art embodiments of FIG. 1(*a-b*).

FIG. 3*b* illustrates the assembled circuit of FIG. 3*a*.

Figure 4A:
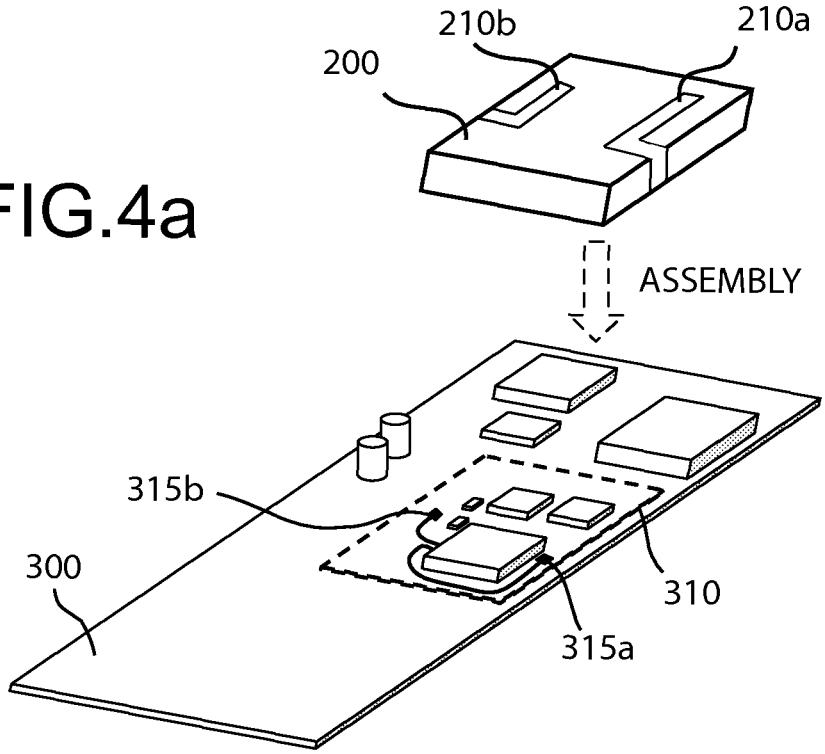

FIG. 4*a* illustrates a shield can comprising two antennas each being disposed on a surface thereof; the antennas being placed on the shield can provides reduced volume when compared to prior art embodiments of FIG. 2(*a-b*).

Figure 4B:
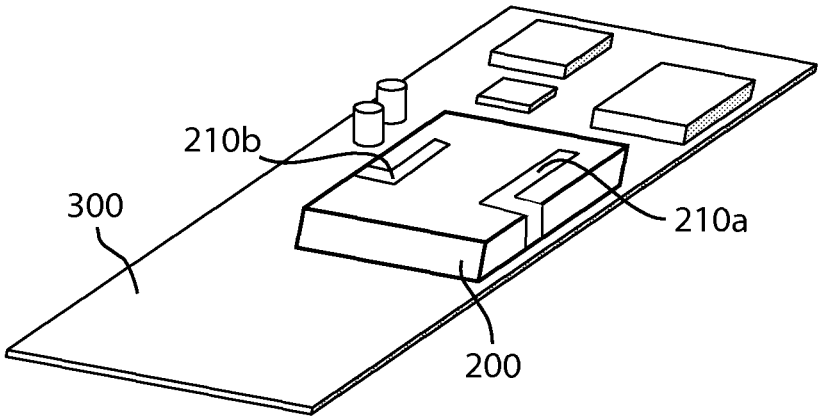

FIG. 4*b* illustrates the assembled circuit of FIG. 4*a*.

Figure 5A:
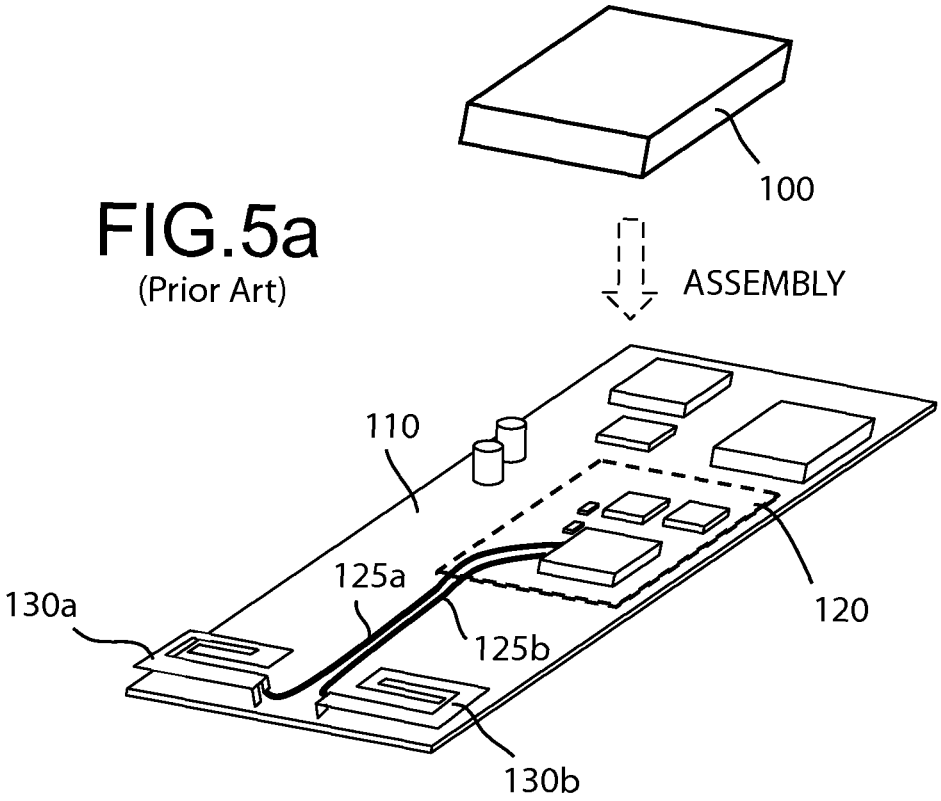
FIG.5a (Prior Art)

FIG. 5*a* illustrates a two-antenna module in accordance with the prior art embodiment of FIG. 2*a*.

Figure 5B:
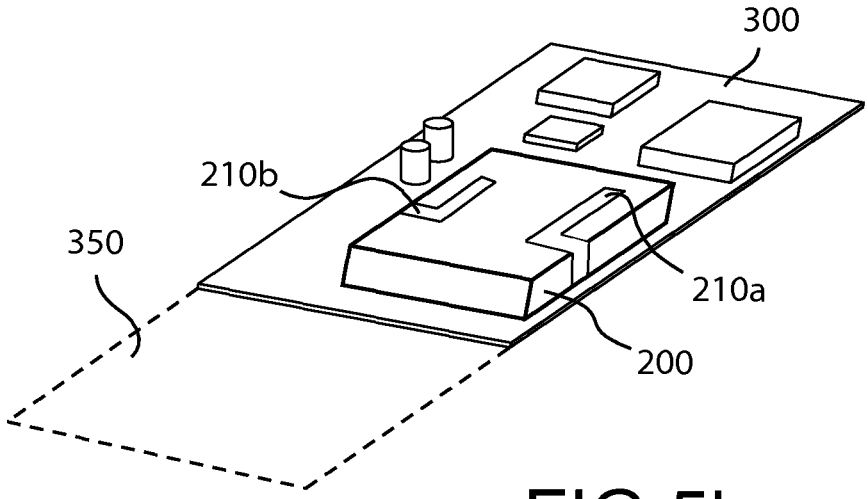

FIG. 5*b* illustrates an amount of space that can be reduced when providing a two-antenna module with the antennas built into a shield can.

Figure 6A:
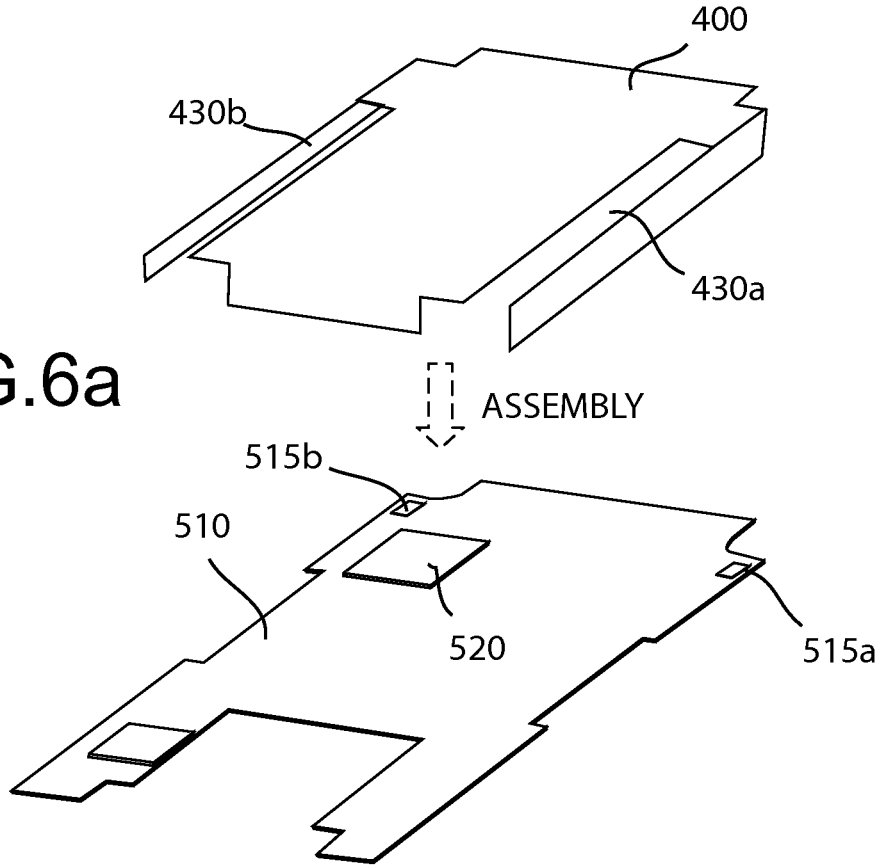

FIG. 6*a* illustrates a shield can comprising a pair of slots etched from a body portion of the shield can, the slots are adapted to radiate RF signals driven from feed contact pads on a circuit board.

Figure 6B:
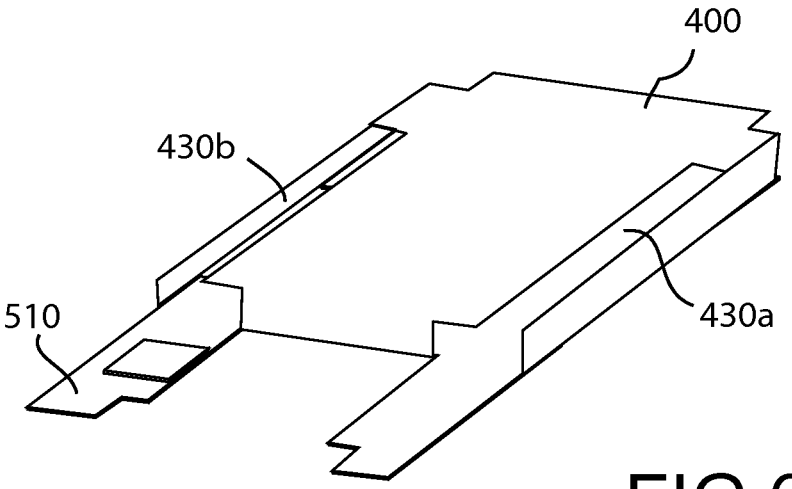

FIG. 6*b* illustrates the assembled circuit of FIG. 6*a*.

Figure 7:
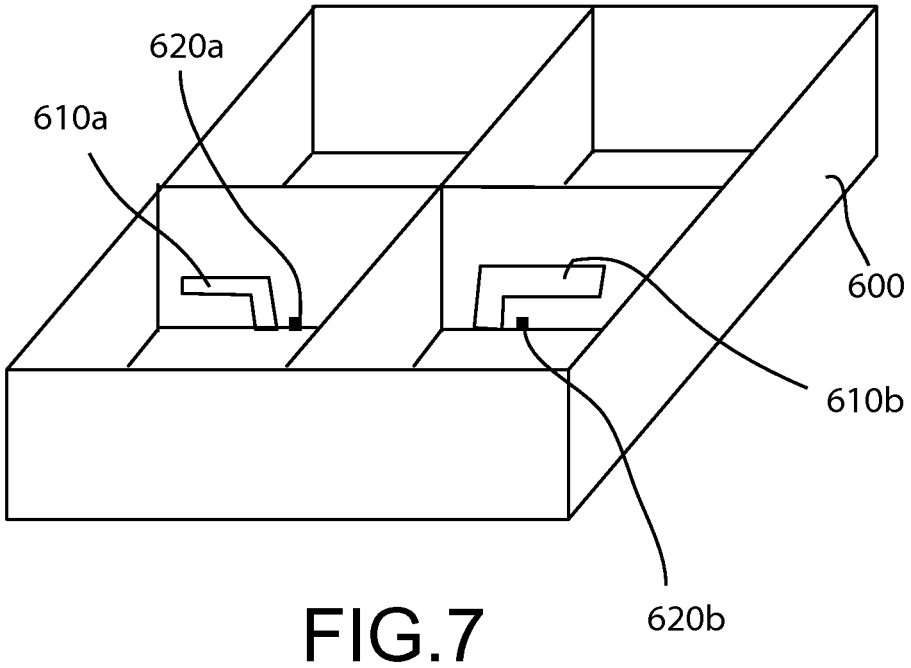

FIG. 7 illustrates a conductive structure comprising slots etched therein for radiating RF signals, the slots are driven by adjacent feed contacts.

Figure 8A:
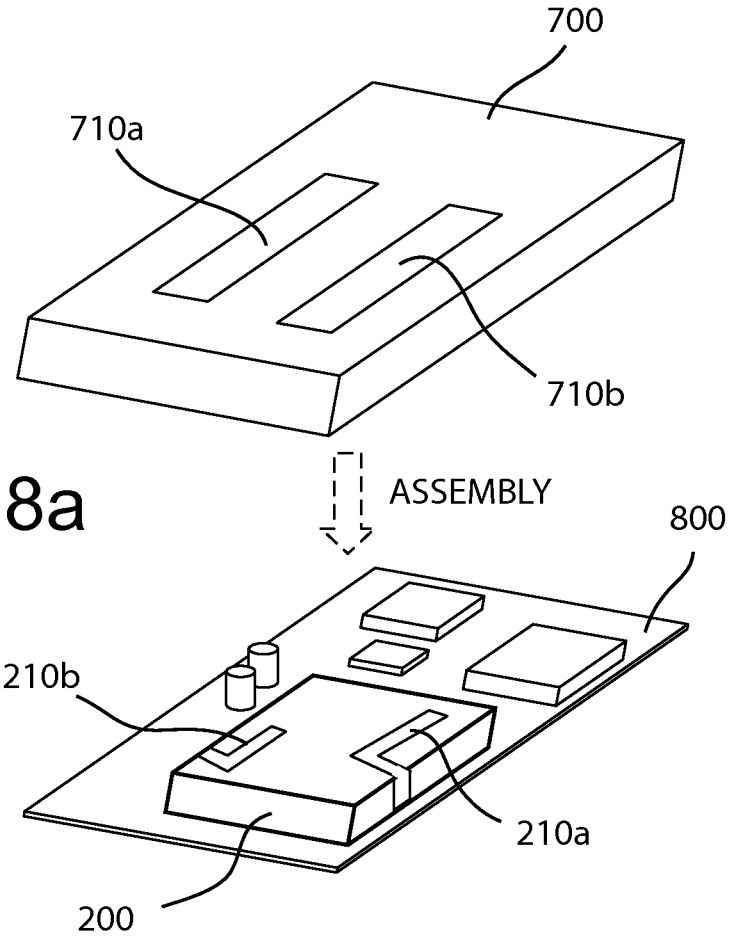

FIG. 8*a* illustrates a shield can having two antennas disposed on a surface thereof, and a conductive structure adapted to substantially surround the shield can, the conductive structure comprises two slots, wherein each of the slots of the conductive structure is adapted to electromagnetically couple with the antennas of the shield can.

Figure 8B:
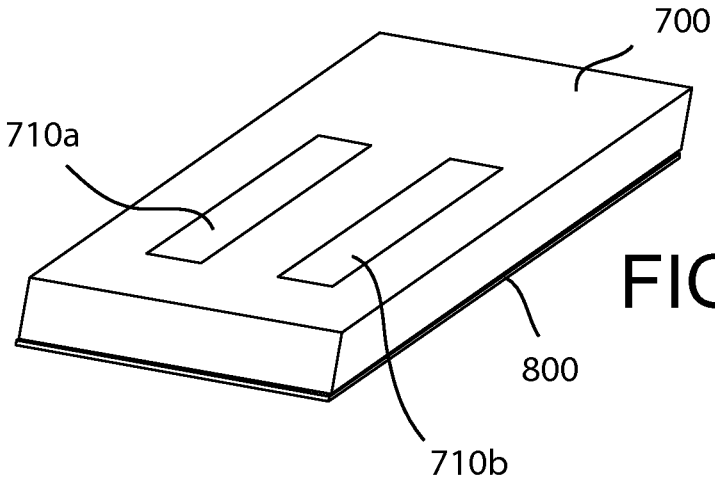

FIG. 8*b* illustrates the assembled circuit of FIG. 8*a*.

Figure 9A:
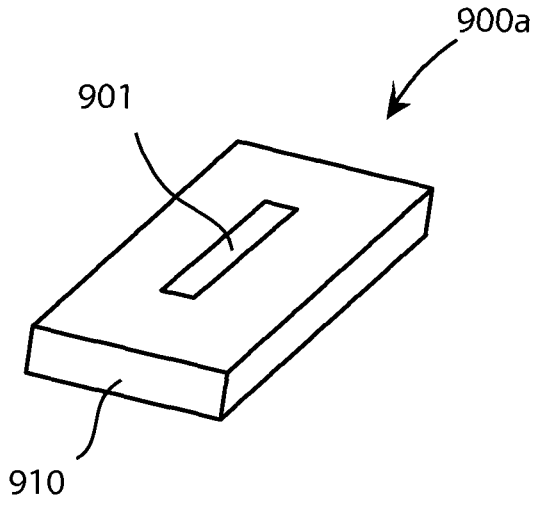

FIG. 9*a* illustrates an embodiment wherein a conductive structure comprises a slot etched into top surface thereof.

Figure 9B:
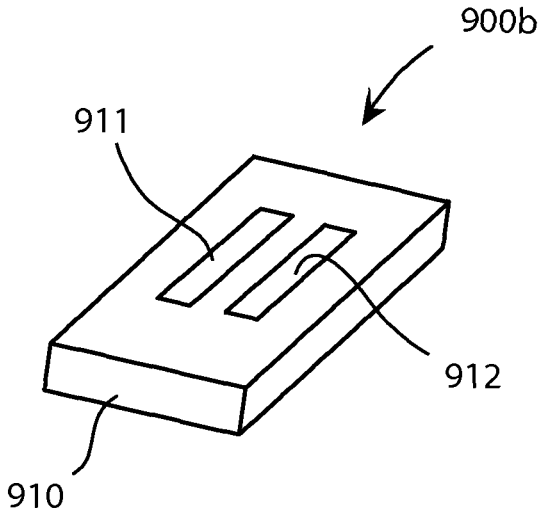

FIG. 9*b* illustrates an embodiment wherein a conductive structure comprises two slots etched into a top surface thereof.

Figure 9C:
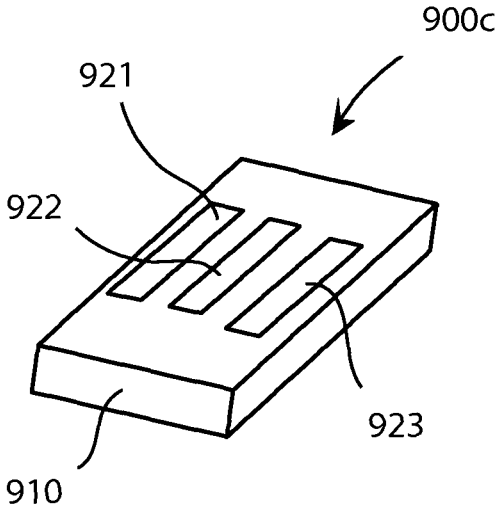

FIG. 9*c* illustrates an embodiment wherein a conductive structure comprises three slots etched into a top surface thereof.

Figure 9D:
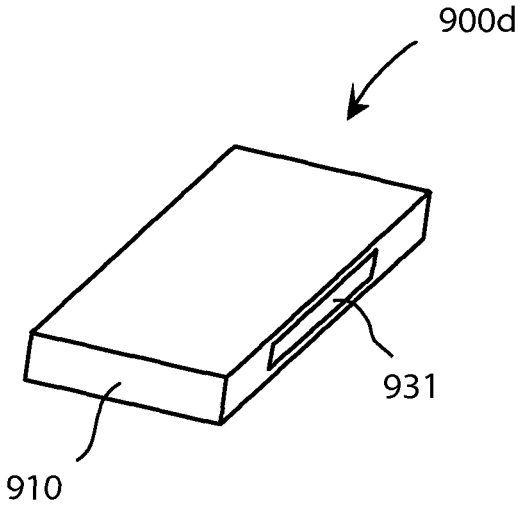

FIG. 9*d* illustrates an embodiment wherein a conductive structure comprises a slot etched into a side surface thereof.

Figure 10A:
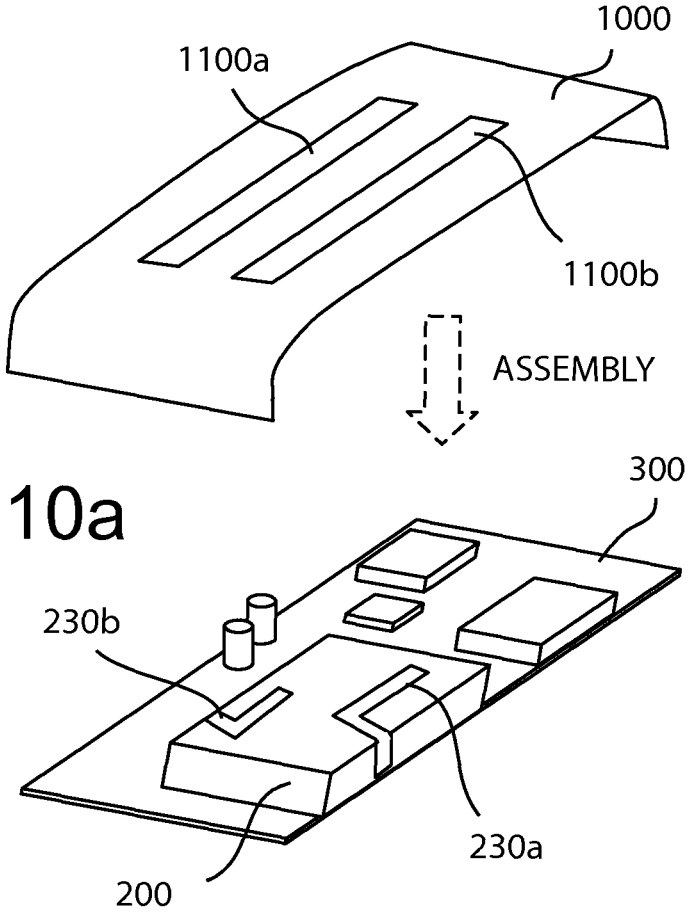

FIG. 10*a* illustrates an embodiment wherein a circuit board comprises a shield can having two antennas therein, and a conductive structure assembled to sat least partially surround the shield can; the conductive structure comprises two slots, wherein each of the slots is adapted to couple with one of the respective antennas of the shield can.

Figure 10B:
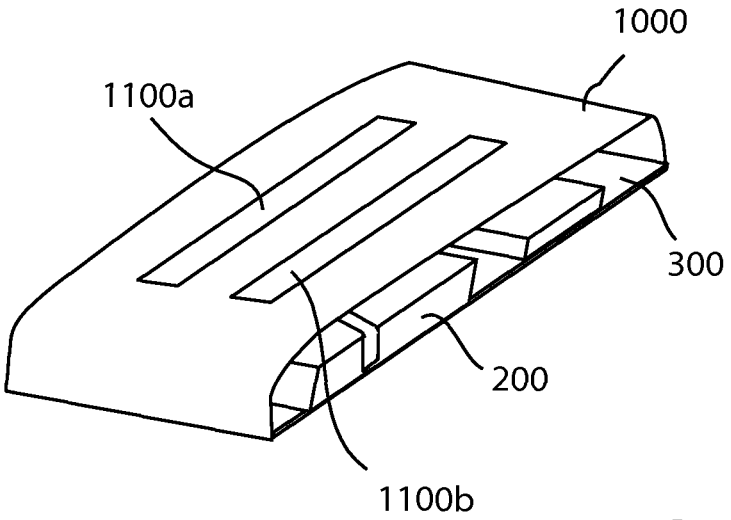

FIG. 10*b* illustrates the assembled circuit of FIG. 10*a*.

DESCRIPTION OF THE PREFERRED EMBODIMENTS

In the following description, for purposes of explanation and not limitation, details and descriptions are set forth in order to provide a thorough understanding of the present invention. However, it will be apparent to those skilled in the art that the present invention may be practiced in other embodiments that depart from these details and descriptions.

In a general embodiment, one or more antennas can be configured within a shield can structure. The shield can comprises a conductive structure having a top surface and one or more side walls extending perpendicular therefrom. The shield can is positioned over at least a portion of a radio circuit of a circuit board, and at least one antenna feed contact is couple to a slot of the shield can for communicating RF currents.

In another embodiment, a second conductive structure is configured to at least partially surround the first conductive structure. In this regard, the second conductive structure may comprise one or more slots therein. The slots of the second conductive structure can be excited by RF currents emitted from the slots of the first conductive structure which are in turn connected to feed contact pads and coupled to the radio circuit.

Each of the first and second structures may individually comprise one or more slots.

Now turning to the drawings, FIG. 1*a* illustrates an embodiment of the prior art wherein an antenna 130 installed on a circuit board portion 110 of a wireless device. A shield can 100 is shown covering at least a portion of an electronic circuit for shielding purposes, and a transmission line 125 is used to connect the transceiver 120 to the antenna 130. FIG. 1*b* illustrates the assembled antenna system. Although the antenna system is functional, the antenna 130 consumes unnecessary space, resulting in a bulkier device volume.

FIG. 2*a* illustrates two antennas 130*a*; 130*b* being installed on the circuit board 110 of a wireless device. A shield can 100 is shown covering at least a portion of an electronic circuit for shielding purposes, and two transmission lines 125*a*; 125*b* are used to connect the transceiver 120 to the antennas. FIG. 2*b* is an assembled antenna system in accordance with FIG. 2*a*. As can be recognized, multiple antenna schemes require a significant volume within the wireless device, especially considering the need to isolate the radiating antennas from the digital circuits of the wireless device.

FIG. 3*a* illustrates an antenna integrated within a shield can. The shield can 200 includes a slot portion 210 etched within a surface thereof, the shield can is further adapted to contact with a feed pad 315 on the circuit board 300; the feed pad supplies an RF signal to the antenna 210 via a transmission line and feed pad 315. The slot can be etched into the conductive shield can structure at a top surface, a side surface, or a combination thereof. FIG. 3*b* illustrates the assembled antenna assembly in accordance with FIG. 3*a*.

FIG. 4 illustrates multiple antennas integrated within a shield can. The shield can body 200 is adapted to contact a pair of feed pads on the circuit board 300; the feed pads supply RF signals to the two antennas 210*a*; 210*b* formed by the slots. Transmission lines connect the feed pads 315*a*; 315*b* to the transceiver 310. The antennas may be positioned on one or more surfaces of the shield can structure, and can be positioned on opposite sides thereof, or alternatively may be positioned on adjacent sides of the shield can structure. FIG. 4*b* illustrates an assembled antenna system in accordance with FIG. 4*a*.

FIGS. 5(*a*-*b*) illustrate a comparison of a traditional two antenna topology (FIG. 5*a*) on a circuit board and a shield can containing two slot antennas according to various embodiments herein. Integrating the antennas into the shield can results in a smaller circuit board, and smaller volume requirement, compared to the traditional antenna topology where discrete antennas are positioned on the circuit board.

According to FIG. 5*a*, a shield can 100 is provided to cover a transceiver and electronic circuit for shielding thereof. A first antenna 130*a* is positioned adjacent to a second antenna 130*b*, wherein each of the first and second antennas are connected to the transceiver via transmission lines. The antenna topology of FIG. 5*a* requires a first volume of the circuit board and components.

In contrast to FIG. 5*a*, FIG. 5*b* illustrates two antennas being integrated within a shield can assembly according to various embodiments of the invention. The shield can assembly includes a shield can body 200 having two slot antennas 210*a*; 210*b* embedded therein. The shield can is placed over the transceiver and circuit and forms contact with one or more feed contact pads on the circuit board 300. As can be understood by those having skill in the art, the volume can be significantly reduced as depicted in FIG. 5*b*.

FIGS. 6(*a*-*b*) illustrate a conductive structure being shaped to form a three dimensional structure 400. In FIG. 6*a*, two slots, including a first slot 430*a* and a second slot 430*b*, are formed along respective sides of the conductive structure. The conductive structure makes contact with two feed pads 515*a*; 515*b* on the circuit board 510 for feeding an RF signal to the slot antennas. FIG. 6*b* illustrates an assembled antenna system in accordance with FIG. 6*a*.

FIG. 7 illustrates a conductive structure having internal walls, wherein slots 610*a*; 610*b* are cut into the internal walls and excited for use as antennas for transmission and/or reception of radiated signals. The internal walls of the structure can be connected to a circuit board via one or more feed contact pads 620*a*; 620*b*.

FIGS. 8(*a*-*b*) illustrate a multi-antenna, multi-shield, shield can assembly comprising a first shield can structure 200 and a conductive enclosure 700 configured to at least partially surround the shield can structure 200. Each of the shield can 200 and conductive enclosure 700 comprises at least one slot 210*a*-210*b*; 710*a*-710*b*, respectively, wherein the at least one slot of the shield can is electrically driven via a transmission line, and wherein the at least one slot of the conductive structure is configured for electromagnetic coupling with a slot of the adjacent shield can. The shield can makes contact with a pair of feed pads on the circuit board 800; the feed pads supply RF signals to the two antennas formed by the slots of the shield can. The conductive enclosure is positioned over the shield can. In essence, the conductive enclosure can be understood as a second shield can. One or multiple slots 710*a*; 710*b* are cut into the conductive enclosure. Radiated signals from the slots cut into the first shield are configured to excite the slots cut into the second shield can, resulting in radiated signals.

FIGS. 9(*a-d*) illustrate a number of examples of slot configurations that can be implemented in conductive structures such as shield cans and conductive enclosures as described herein. These examples are not limiting of the several variations possible, and are therefore not intended to be limiting in scope. One or multiple slots can be positioned on a top, side, or bottom surface of a conductive structure, or in a combination thereof.

FIG. 10 illustrates an antenna integrated in a shield can assembly; the antenna comprises two slots 230*a*; 230*b* etched from a first shield can 200. The first shield can makes contact with a pair of feed pads on the circuit board; the feed pads supply RF signals to the two antennas formed by the slots. A conductive housing 1000 is positioned over the circuit board containing the first shield can 200. One or multiple slots 1100*a*; 1100*b* are etched from the conductive housing. Radiated signals from the slots etched from the first shield can are configured to excite the slots etched from the conductive housing, resulting in radiated signals of the housing.

Thus, in accordance with the invention, an antenna system is integrated within a shield can. The antenna system comprises a circuit board having a radio circuit and an antenna contact pad thereon; a shield can formed by a conductive structure having a top surface and one or more side walls extending perpendicular therefrom, the shield can being connected to the circuit board at one or more of the side walls such that at least a portion of the radio circuit is surrounded by the shield can; and a slot etched into the shield can; the slot being coupled to the antenna contact pad of the circuit board; wherein the slot is adapted to radiate an electromagnetic signal.

Moreover, an antenna system in another embodiment comprises a first conductive structure having a top surface and one or more sidewalls extending perpendicular therefrom; a second conductive structure having a top surface and one or more sidewalls extending perpendicular therefrom; a circuit board comprising a radio circuit; the first conductive structure further comprising a first slot etched therefrom, the first conductive structure being attached to the circuit board and configured to surround at least a portion of the radio circuit; the second conductive structure further comprising a second slot etched therefrom, the second conductive structure being attached to the circuit board and positioned surround at least a portion of the first conductive structure; wherein RF currents radiating from the first slot is adapted to excite the second slot for RF communication.

In another aspect of the invention, a method comprises: (i) etching one or more first slots into a first conductive structure having a top surface and one or more side walls extending perpendicular therefrom to form a first shield can; (ii) providing at least one antenna feed contact on a circuit board for coupling with a slot of the first shield can; and (iii) assembling the shield can having a slot portion thereon with the circuit board such that the slot of the first shield can is adapted to radiate RF currents from a transceiver on the circuit board.

In another embodiment, a method further comprises (iv) etching one or more second slots into a second conductive structure adapted to attach to the circuit board and surround at least a portion of the first shield can; (v) attaching the second conductive structure to the circuit board such that the one or more second slots are positioned adjacent to the one or more first slots of the first conductive structure such that RF currents emitted form the first slots are adapted to excite the second slots.

The invention claimed is:

1. An antenna system, comprising:

a circuit board having a radio circuit thereon, the radio circuit including an antenna feed pad disposed on the circuit board;

a shield can coupled to the circuit board and configured to at least partially surround the radio circuit, the shield can comprising a first slot extending along at least one surface of the shield can, the shield can coupled to the antenna feed pad and configured to communicate signals from the antenna feed pad to excite the first slot; and a conductive enclosure coupled to the circuit board and configured to at least partially surround the shield can, said conductive enclosure comprising a second slot disposed on at least one surface of the conductive enclosure, said second slot of the conductive structure being positioned adjacent to the first slot of the shield can;

wherein the first slot of the shield can is configured to excite the second slot of the conductive enclosure for radiating signals therefrom.

2. The antenna system of claim 1, comprising two or more antenna feed pads each being individually disposed on the circuit board and configured to couple with the shield can.

3. The antenna system of claim 2, said shield can comprising two or more first slots, each of the first slots being configured for excitation from one of the two or more antenna feed pads.

4. The antenna system of claim 3, said conductive enclosure comprising two or more second slots, each of the second slots being positioned adjacent to one of the two or more first slots of the shield can.

5. The antenna system of claim 1, said shield can comprising: a top surface, and one or more side walls extending perpendicularly from the top surface.

6. The antenna system of claim 5, wherein said first slot is disposed on said top surface, one of said side walls, or a combination thereof.

7. The antenna system of claim 5, wherein said first slot is disposed on said top surface of the shield can.

8. The antenna system of claim 5, wherein said first slot is disposed on one of said side walls of the shield can.

9. An antenna system, comprising:

a circuit board having a radio circuit thereon, the radio circuit including a first antenna feed pad and a second antenna feed pad, each of the feed pads being disposed on the circuit board;

a shield can coupled to the circuit board and configured to at least partially surround the radio circuit, the shield can comprising two first slots, each of the first slots extending along at least one surface of the shield can, the shield can being coupled to the antenna feed pads, and each of the first slots being individually excited from signals originating from one of the first and second feed pads; and a conductive enclosure coupled to the circuit board and configured to at least partially surround the shield can, said conductive enclosure comprising two second slots, each of the second slots disposed on at least one surface of the conductive enclosure, and each of the second slots of the conductive structure being positioned adjacent to one of the first slots of the shield can;

wherein each of the first slots of the shield can is configured to excite one of the second slots of the conductive enclosure for radiating signals therefrom.

10. The antenna system of claim 9, said radio circuit including three or more feed pads.

11. The antenna system of claim 9, said shield can comprising three or more first slots.

12. The antenna system of claim 9, said conductive enclosure comprising three or more second slots.

13. The antenna system of claim 9, said radio circuit including three or more feed pads, said shield can comprising three or more first slots, and said conductive enclosure comprising three or more second slots, wherein each of the first slots of the shield can is configured to excite one of the second slots of the conductive enclosure for radiating signals therefrom.

* * * * *